US006092318A

United States Patent [19]

Arie et al.

[11] Patent Number: 6,092,318

[45] Date of Patent: Jul. 25, 2000

[54] SOLAR BATTERY TYPE INDICATION APPARATUS

[75] Inventors: Shigeyoshi Arie, Moriguchi; Takashi Odaira, Ota; Nobuaki Takai, Oizumi-machi; Fusao Terada, Ota; Kiyondo Kobayashi, Ashikaga; Yoshitaka Hara, Menuma-machi; Akira Okonogi, Chiyoda-machi; Katuji Wakabayashi; Masashi Takazawa, both of Oizumi-machi, all of Japan

[73] Assignee: Sanyo Electric Co., Ltd., Moriguchi, Japan

[21] Appl. No.: 08/787,179

[22] Filed: Jan. 23, 1997

[30] Foreign Application Priority Data

| | | | |
|---|---|---|---|
| Jan. 24, 1996 | [JP] | Japan | 8-010320 |
| Jan. 31, 1996 | [JP] | Japan | 8-035831 |
| Aug. 8, 1996 | [JP] | Japan | 8-225964 |
| Aug. 8, 1996 | [JP] | Japan | 8-225965 |
| Aug. 8, 1996 | [JP] | Japan | 8-225966 |
| Aug. 8, 1996 | [JP] | Japan | 8-225967 |
| Aug. 8, 1996 | [JP] | Japan | 8-225968 |

[51] Int. Cl.[7] ..... G09F 13/00

[52] U.S. Cl. ..... 40/547; 40/550; 362/812

[58] Field of Search ..... 40/547, 612, 550; 340/815.42; 362/32, 812

[56] References Cited

U.S. PATENT DOCUMENTS

| | | | |
|---|---|---|---|
| 4,917,448 | 4/1990 | Oppenheimer | 350/96.1 |
| 4,922,384 | 5/1990 | Torrence | 362/31 |
| 5,005,931 | 4/1991 | Mori | 350/96.1 |
| 5,007,190 | 4/1991 | Shyu | 40/564 |
| 5,040,320 | 8/1991 | Reidinger | 40/570 |
| 5,103,581 | 4/1992 | Novak | 40/547 |
| 5,151,679 | 9/1992 | Dimmick | 340/326 |
| 5,193,893 | 3/1993 | Mitko | 362/32 |
| 5,231,689 | 7/1993 | Reidinger | 385/147 |
| 5,295,221 | 3/1994 | Roslan | 385/147 |
| 5,398,170 | 3/1995 | Lee | 362/32 |
| 5,408,773 | 4/1995 | Hwang | 40/547 |
| 5,435,087 | 7/1995 | Karkar et al. | 40/564 X |
| 5,542,203 | 8/1996 | Luoma et al. | 40/610 |
| 5,546,289 | 8/1996 | Gordon | 362/101 |
| 5,573,328 | 11/1996 | Hwang | 362/183 |
| 5,761,158 | 6/1998 | Azuma et al. | 368/205 |
| 5,819,455 | 10/1998 | Tsuda | 40/550 X |

FOREIGN PATENT DOCUMENTS

| | | | |
|---|---|---|---|
| 2835197 | 4/1979 | Germany | 40/547 |
| 6-110392 | 4/1994 | Japan | 40/547 |
| 8500959 | 11/1986 | Netherlands | 40/547 |

*Primary Examiner*—Brian K. Green

*Attorney, Agent, or Firm*—Oblon, Spivak, McClelland, Maier & Neustadt, P.C.

[57] ABSTRACT

A solar battery indicator apparatus utilizing a capacitor for accumulating electrical power generated by the solar battery and light emitting diodes for emitting light on the basis of the electrical power supplied from the capacitor. An indicator body makes a prescribed indication on its front surface through the use of optical fibers. Several bundles of optical fibers are utilized with each bundle being associated with a plurality of optical fibers having one of their ends disposed to face an associated one of the light emitting diodes and the other end of each of the bundles of fibers being associated with a particular indicator. The configuration of optical fiber bundles utilize a control portion for controlling light emitting states of respective individual light emitting diodes. In another aspect a bundle of optical fibers have their connection to a light emitting diode such that the light emitting diode and the connection is positioned substantially in the center portion of a sign indicator controlled by the light emitting diode so that the curvature of the individual optical fibers is within a range for optimal light transmission.

4 Claims, 12 Drawing Sheets

SOLAR BATTERY TYPE INDICATION APPARATUS

BACKGROUND OF THE INVENTION

1. Field of the invention

The present invention relates to a solar battery type indication apparatus used in road signs, guide signs, or the like, and particularly relates to a solar battery type indication apparatus which is improved to attain reduction both in weight and in cost and eliminate the unevenness of bending of optical fibers to thereby make it possible to perform light transmission securely, receive various parts in a body of the indication apparatus efficiently and connect the optical fibers easily without entanglement in the indication apparatus body.

Further, the present invention relates to an indication apparatus for performing an indication by using light from light-emitting diodes (LEDs), a light source such as a solar lighting apparatus, or the like, and particularly relates to an indication apparatus which is improved in optical fiber-mounting property.

2. Description of the Related Art

First Prior Art

Recently, self-light-emitting signs in which a plurality of light emitters arranged in a sign panel are lighted in the night to improve visibility have been used as road signs or as guide signs such as signboards.

In the case where a commercial power supply is used as an electric source for such a self-light-emitting sign of this type, equipmental cost becomes high because aerial cable laying, underground cable laying, or the like, is required.

Further, such a self-light-emitting sign of this type cannot be used in districts such as a district deep in the mountains in which it is difficult to supply any electric source.

Therefore, use of a solar battery as the electric source is thought of.

In this case, a solar battery and a storage battery are provided and a lead battery, a Ni—Cd battery, or the like, is used as the storage battery.

Such a secondary battery, however, not only need be supplemented with water every predetermined period but also need be replaced by a new one every several years because the cycle life of the secondary battery is short. Accordingly, there arises a problem that the maintenance of the secondary battery is very troublesome.

Therefore, use of an electric double-layer capacitor instead of such a secondary battery is disclosed, for example, in JP-A-7-129108. Because such an electric double-layer capacitor is long in cycle life, and does not require maintenance such as water supplement.

In a conventional solar battery type self-light-emitting sign, however, a considerably large number of light emitters must be arranged in the indication panel because characters, or the like, are formed from a plurality of light emitters. Although light-emitting diodes (LEDs), or the like, are used as the light emitters, electric power consumed at the time of lighting of the light emitters is very large. Accordingly, a large number of electric double-layer capacitors must be provided so that electric power of the electric double-layer capacitors is not insufficient even in the night.

In addition, a considerably large solar battery is required because it is necessary to generate electric power as much as possible in the day. Accordingly, there arises a problem that the cost of the solar battery type self-light-emitting sign becomes considerably high.

In addition, the solar battery must be fixed to a prop tightly because the weight of the solar battery is heavy. Further, the work for laying the solar battery type self-light-emitting sign is heavy because the weight of the solar battery type self-light-emitting sign including the solar battery, or the like, attached thereto is heavy.

Second Prior Art

As such an indication apparatus, there are, for example, conventional apparatuses using a lighting apparatus, or the like, as shown in FIGS. 13 and 14.

FIG. 13 is a configuration view of a conventional indication apparatus.

In FIG. 13, the reference numeral 501 designates a lighting apparatus; 502, a semispherical transparent cover; 503*a* and 503*b*, lighting elements such as lighting prisms, or the like; 504, a plurality of optical fibers for transmitting sunlight caught through the lighting elements 503*a* and 503*b*; and 505, an indicator provided with characters such as "STOP", or the like, which are indicated by radiating output light of the optical fibers 504. Further, the reference character F designates a frame for supporting the lighting apparatus 501.

As shown in FIG. 13, the lighting apparatus 501 is covered with the semispherical transparent cover 502 and the lighting elements 503*a* and 503*b* are controlled to be at predetermined rotation angles correspondingly to the movement of the sun so that input sunlight rays $L_1$ transmitted through the transparent cover 502 change to output light rays $L_2$ always kept in a predetermined direction with respect to upper ends 504*a* of the optical fibers 504.

That is, the output light rays of the lighting elements 503*a* and 503*b* are transmitted through the optical fibers 504 to indication portions 505*a* of the indicator 505 so that the description "STOP" provided on the indicator 505 is irradiated with the light radiated from the indication portions 505*a*. Thus, the description is transmitted visually to the outside.

Incidentally, fixtures for fixing the optical fibers 504 to the indicator 505 in such an indication apparatus of this type are conventionally configured as shown in FIG. 14.

That is, as shown in FIG. 14, in the conventional apparatus, optical fibers 504A provided on the indicator 505 are inserted into corresponding insertion holes 505*h* each having a diameter considerably larger than the diameter of each of the optical fibers 504A and the optical fibers 504A are fixed to the indicator 505 with an adhesive agent S.

Incidentally, the conventional indication apparatus has the following problems because the optical fibers 504A are fixed to the indicator 505 with the adhesive agent S as described above and because the optical fibers 504A are fixed such that a description is indicated on the indicator 505 by using light directly outputted from the optical fibers 504A.

First, because gaps between the insertion holes 505*h* and the optical fibers 504A are filled with the adhesive agent S, the positions and directions of the optical fibers 504A fixed to the indicator 505 may vary depending on the worker.

Further, because it is necessary to fix the optical fibers 504A until the adhesive agent S is solidified, the workability is poor.

Further, the period of fixture of the optical fibers 504A is short because of the deterioration of the adhesive agent S.

Further, various indication apparatuses of the type using a fluorescent lamp as a back light in order to light the indicator are available in the market but electric power consumed by those indication apparatuses is large so that the indicator cannot be lighted correspondingly to the time zone. That is, because the apparatuses of the type using a fluorescent lamp are large in the quantity of electricity, indication apparatuses of the type capable of being always recognized from the outside even in the dark place with a low quantity of electricity have been demanded.

Third Prior Art

Generally, there is known a solar battery type indication apparatus comprising a control substrate, a capacitor capable of accumulating electric power generated by the solar battery, light emitters for emitting light in response to the generated electric power, and a sign portion for leading the light emitted by the light emitters to light-emission ends through optical fibers to form a predetermined sign. In such a conventional solar battery type indication apparatus, electric power from the solar battery is stored or accumulated in a storage battery, a capacitor, or the like, in the day, and the accumulated electric power is taken out to perform an indication in the night. For example, a plurality of such indication apparatuses are used in combination for performing a predetermined indication (for example, of an arrow sign indicating the existence of a curve in a forward position in the direction of movement on the road).

In the conventional indication apparatus, because a portion for binding the optical fibers to be connected the light emitters is not disposed in the center of the sign of the sign portion, the distances between the binding portion and light-emission ends arranged in the contour portion of the sign are not equal so that the lengths of the large number of optical fibers are different. Accordingly, there arises a problem that the work for connecting the optical fibers is difficult.

Furthermore, because a value not smaller than the acceptable radius of curvature (R) of the optical fibers defined on the basis of the diameter of the optical fibers cannot be ensured when the optical fibers are distributed, the optical fibers are curved unevenly. There arises a problem that the transmission of light in the optical fibers becomes unreliable.

Fourth Prior Art

In a conventional indication apparatus, various parts including a large number of optical fibers, a large-scale capacitor, etc. are received in a body of the indication apparatus.

There is, however, conventionally no proposal concerning layout for putting various parts inclusive of a large number of optical fibers in the body efficiently.

Fifth Prior Art

In a conventional indication apparatus, light-emission ends of the sign portion are attached to the sign panel portion whereas the light emitters are attached to a side wall of the body.

The conventional configuration, however, has a problem that the work for connecting the large number of optical fibers between the light-emission ends of the sign portion and the light emitters is difficult.

That is, in the conventional configuration, after one end of each of the optical fibers is connected to corresponding one of the light emitters in the side wall of the body, the sign panel portion must be incorporated into the side wall and then the opposite end of the optical fiber must be connected to corresponding one of the light-emission ends of the sign panel portion. The work for connecting the optical fibers after the incorporation of the sign panel portion into the side wall is very difficult.

Six Prior Art

In a conventional indication apparatus, various parts including a large number of optical fibers, a control substrate, a large-scale capacitor, etc. are received in the body.

There is, however, conventionally no proposal concerning layout for receiving various parts inclusive of a control substrate, a large-scale capacitor, etc. in the indication apparatus body efficiently.

Seventh Prior Art

In a conventional indication apparatus, light-emission ends of the sign portion are connected to light emitters by using a large number of optical fibers in a body of the indication apparatus.

The work for connecting the light-emission ends of the sign portion to the light emitters through the optical fibers in the indication apparatus body is very difficult. For example, this is because the light-emission ends of the sign portion express the contour of a predetermined sign and because the number of the optical fibers increases as the shape showing the predetermined sign becomes more complex, so that the optical fibers connecting the light-emission ends of the sign portion to the light emitters are entangled with each other in the apparatus body.

SUMMARY OF THE INVENTION

Therefore, an object of the present invention is to provide a solar battery type indication apparatus in which reduction both in weight and in cost is attained.

Another object of the present invention is to provide a solar battery type indication apparatus in which optical fibers can be connected simply to thereby eliminate unevenness of bending of the optical fibers and perform light transmission securely.

A further object of the present invention is to provide a solar battery type indication apparatus in which various parts can be received in a body of the indication apparatus efficiently.

A still further object of the present invention is to provide a solar battery type indication apparatus in which the work for connecting optical fibers can be performed simply.

Another object of the present invention is to provide a solar battery type indication apparatus in which a control substrate, a capacitor, etc. can be received in a body of the indication apparatus efficiently.

A further object of the present invention is to provide a solar battery type indication apparatus in which optical fibers in a body of the indication apparatus can be connected easily without entanglement.

A still further object of the present invention is to provide an indication apparatus which can be applied as a solar battery type indication apparatus in which the work for fixing the optical fibers is performed easily to thereby improve attaching properties.

To achieve the foregoing objects, according to an aspect of the present invention, there is provided a solar battery type indication apparatus comprising: a solar battery; a capacitor for accumulating electric power generated by said solar battery; light-emitting diodes for emitting light on the basis of said electric power supplied from said capacitor; an indicator for making a necessary indication on its front surface; and optical fibers with their one-ends disposed to face said light-emitting diodes and with their other-ends disposed on said indicator.

In the above solar battery type indication apparatus, preferably, said capacitor is constituted by an electric double-layer capacitor; and said necessary indication on said indicator is expressed by using characters, figures and/or symbols.

In the above solar battery type indication apparatus, preferably, said indicator is made hollow so that said electric double-layer capacitor and said light-emitting diodes are received in an inside of said indicator; and said solar battery is put on an upper surface of said indicator so as to be united with said indicator into one body.

In the above solar battery type indication apparatus, preferably, the apparatus further comprises: optical fiber bundles arranged correspondingly to characters, figures and/or symbols indicated on said indicator; light-emitting diodes respectively corresponding to said optical fiber bundles; and a control portion for controlling light-emitting states of said light-emitting diodes individually.

According to another aspect of the present invention, there is provided a solar battery type indication apparatus comprising light emitters for emitting light in response to electric power generated by a solar battery, and an indicator for leading said light emitted by said light emitters to light-emission ends through optical fibers so as to serve as a sign portion forming a predetermined sign, wherein a portion for binding said optical fibers to be connected to said light emitters is disposed substantially in a center of the sign of said indicator.

In the above solar battery type indication apparatus, preferably, the portion for binding said optical fibers to be connected to said light emitters is disposed substantially in a center of the sign of said indicator indicating an arrow.

In the above solar battery type indication apparatus, preferably, said light emitters are attached to a sign panel portion of an indication apparatus body on which said indicator is provided.

In the above solar battery type indication apparatus, preferably, a holder is attached to said sign panel portion of said indication apparatus body in which said sign portion is provided; a mount is attached to said holder; and said light emitters and said portion for binding said optical fibers to be connected to said light emitters are provided in said mount.

In the above solar battery type indication apparatus, preferably, a holder is attached to said sign panel portion of said indication apparatus body in which said sign portion is provided; said light emitters and said portion for binding said optical fibers to be connected to said light emitters are provided on said mount; and at least said optical fiber-binding portion is formed so as to be rotatable.

In the above solar battery type indication apparatus, preferably, said light emitters and said portion for binding said optical fibers to be connected to said light emitters are provided on said mount; and said mount is formed so as to be rotatable.

According to a further aspect of the present invention, there is provided a solar battery type indication apparatus comprising a control substrate, a capacitor capable of accumulating electric power generated by a solar battery, light emitters for emitting light in response to said generated electric power, and an indicator for leading the light emitted from said light emitters to light-emission ends through optical fibers so as to serve as a sign portion forming a predetermined sign, wherein said control substrate, said light emitters, said sign portion and said capacitor are received in a body of said indication apparatus in an order of said control substrate, said light emitters, said sign portion and said capacitor from one side of said indication apparatus body to the other side thereof.

In the above solar battery type indication apparatus, preferably, said control substrate is fixed to said one side of said indication apparatus body; and said capacitor is fixed to said other side of said indication apparatus body.

In the above solar battery type indication apparatus, preferably, said control substrate is electrically insulatably fixed on an inner surface of a side wall of said indication apparatus body.

In the above solar battery type indication apparatus, preferably, a receiving holder is provided on an inner surface of a side wall of said indication apparatus body so that said capacitor is received in said receiving holder.

In the above solar battery type indication apparatus, preferably, said control substrate is electrically insulatably fixed on the inner surface of one side wall of said indication apparatus body; and a receiving holder is provided on an inner surface of the other side wall of said indication apparatus body so that said capacitor is received in said receiving holder.

According to a still further aspect of the present invention, there is provided an indication apparatus comprising light-emitting diodes, optical fibers for transmitting light from said light-emitting diodes, and an indicator for receiving the light from said optical fibers so that a necessary indication is made on said indicator by using said optical fibers, said indication apparatus further comprising: fixtures being equal in number to said optical fibers and respectively having holes for fitting said optical fibers correspondingly and respectively having lens portions at their ends; and mount holes provided in said indicator for mounting said fixtures respectively correspondingly, wherein after said optical fibers for transmitting light from said light-emitting diodes or from a light source such as a solar lighting apparatus are fitted into said respective mount holes of said indicator and ends of said optical fibers are fitted into said respective fitting holes of said fixtures, said fixtures are attached into said mount holes respectively to thereby fix said optical fibers to said indicator.

According to another aspect of the present invention, there is provided an indication apparatus comprising light-emitting diodes, optical fibers for transmitting light from said light-emitting diodes, and an indicator for receiving said light from said optical fibers so that a necessary indication is made on said indicator by using said optical fibers, said indication apparatus further comprising: fixtures respectively having through-holes and being equal in number to said optical fibers; lens bodies respectively having lens portions at their ends and respectively having trunk portion serving as optical fiber-fitting holes in their center portions, said lens bodies being equal in number to said optical fibers; and mount holes provided in said indicator for mounting said fixtures respectively, wherein after said fixtures are fitted respectively into said mount holes of said indicator from tail portions of said fixtures so that head portions of said fixtures are put on a rear surface side of said indicator, and said optical fibers are inserted respectively into said through-holes of said fixtures from the rear surface side of said indicator, ends of said optical fibers are fitted into said respective fitting holes of said lens bodies so as to face said lens portions and said lens bodies are fitted respectively into said through-holes of said fixtures so that said lens portions are disposed on a front surface side of said indicator to thereby fix said optical fibers to said indicator.

In the above indication apparatus, preferably, each of said fitting holes or through-holes of said fixtures forms an inclined surface so that said fitting hole or through-hole is widened toward a tail portion of said fixture.

In the above indication apparatus, preferably, each of said fixtures is made from an elastic material.

DETAILED DESCRIPTION OF THE INVENTION

Embodiment 1

Figure 1:
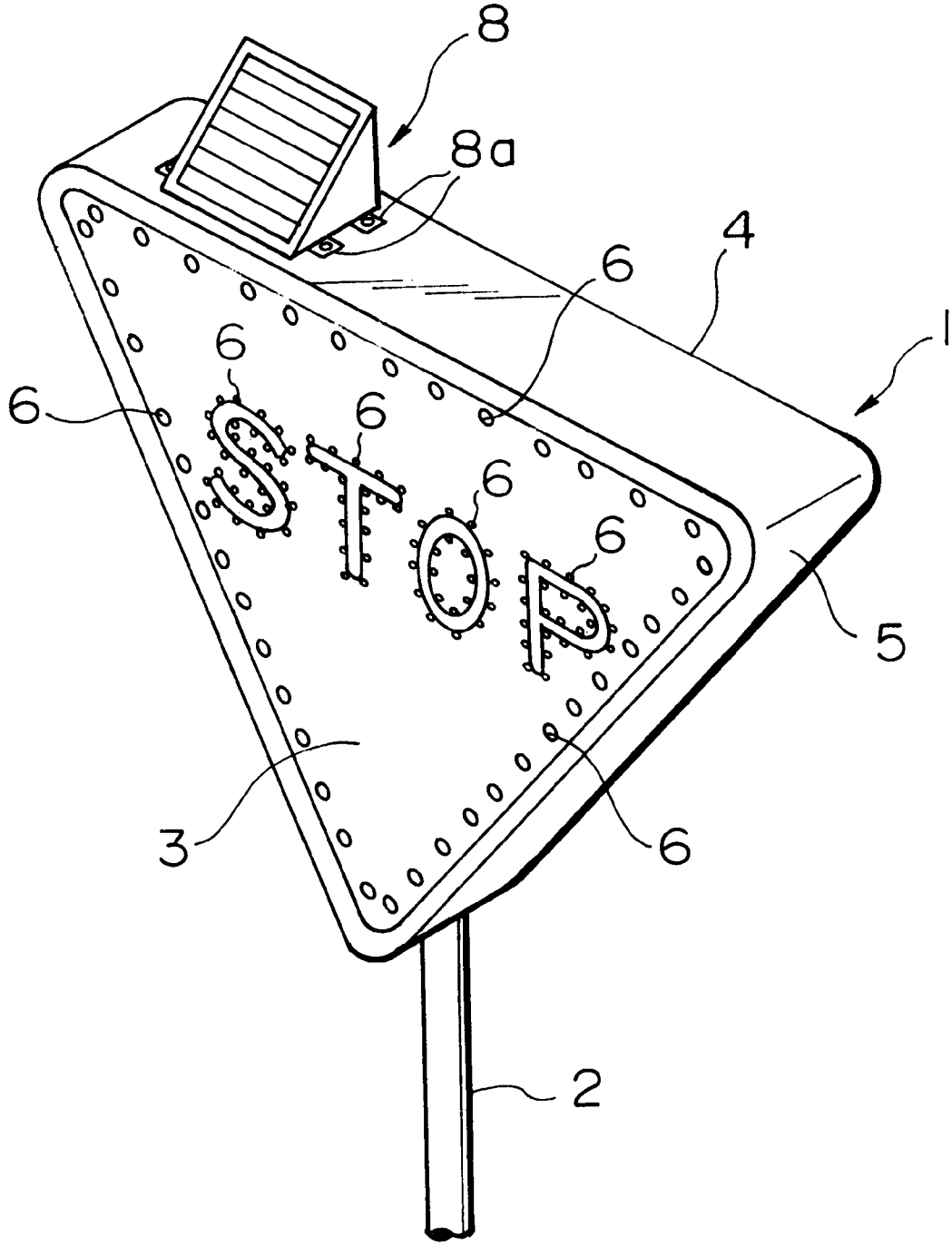
FIG. 1 is a perspective view of a solar battery type indication apparatus showing Embodiment 1 of the present invention.
Figure 2:
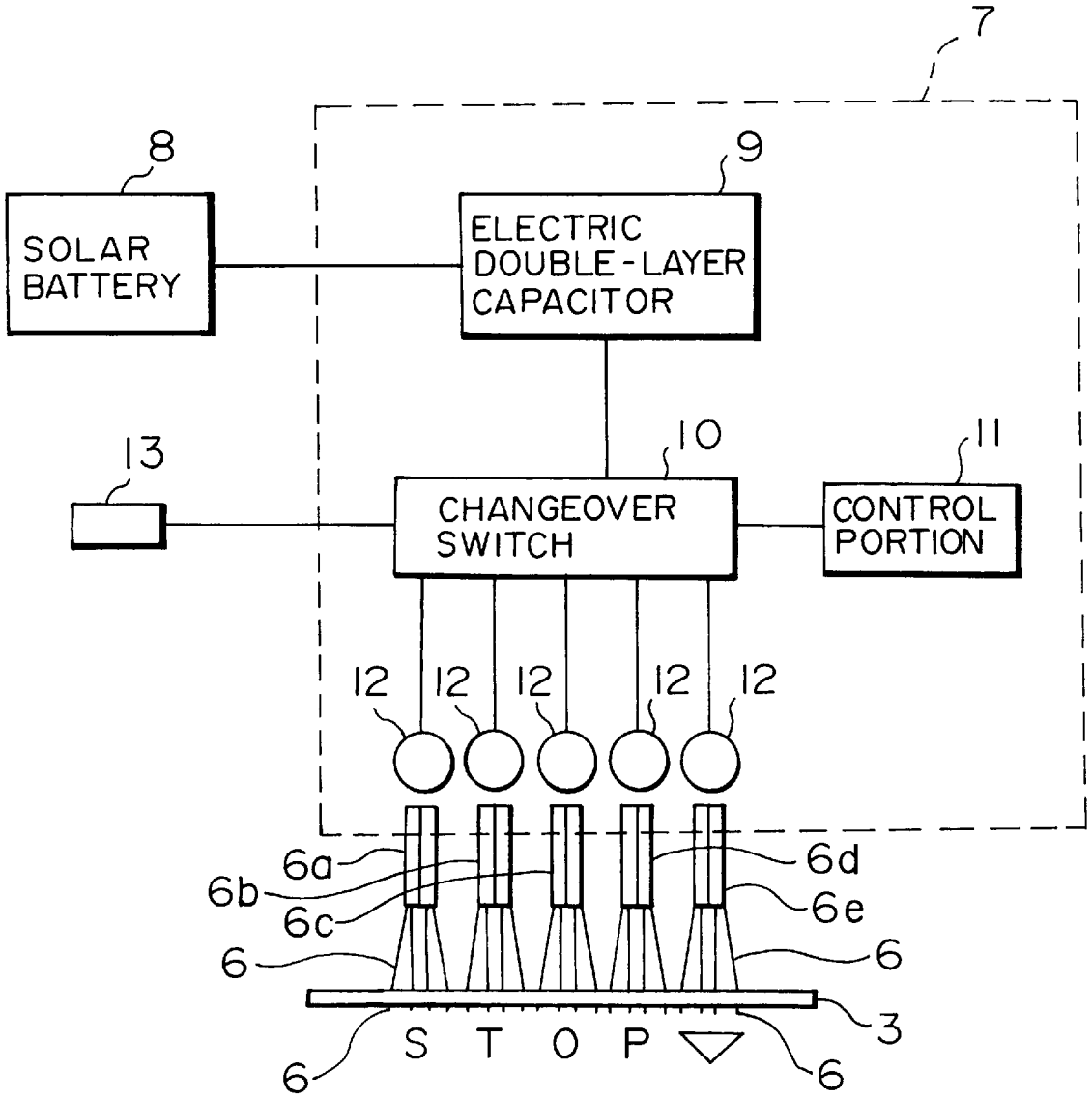
FIG. 2 is a block diagram of the solar battery type indication apparatus showing the Embodiment 1 of the present invention.

Embodiment 1 of the present invention will be described below with reference to the drawings. FIG. 1 is a perspective view of a solar battery type indication apparatus showing this embodiment, and FIG. 2 is a block diagram of the solar battery type indication apparatus showing this embodiment.

In FIG. 1, the reference numeral 1 designates an indicator fixed to a prop 2. The indicator 1 is composed of an indication panel 3, a back plate 4, and a side portion 5. Although this embodiment shows the case where the indicator 1 is a road sign "STOP", it is a matter of course that the present invention is not limited to the road sign, but applicable to a signboard, a guide sign, or the like.

The indication panel 3 is substantially triangular, has characters "STOP" printed in the center, and is rimmed with red zones in its circumference. A plurality of holes are formed in the indication panel 3 so that one end of each of optical fibers 6 which will be described later is disposed in corresponding one of the holes. Although this embodiment shows the case where the optical fibers 6 are arranged so as to rim the respective characters, the invention can be applied to the case where the optical fibers 6 are arranged in printed portions of the characters.

The back plate 4 is shaped like a triangle having the same size as the indication panel 3 and has an openable/closable outlet (not shown) formed in the center portion. The side portion 5 is shaped like a triangular pipe. Opening portions in the opposite ends of the pipe-like side portion 5 are covered with the indication panel 3 and the back plate 4 so that the indicator 1 is made hollow. As shown in FIG. 2, optical fibers 6, an electrical equipment portion 7, etc. are received in the indicator 1. When the work for setting the electrical equipment portion 7 or for performing maintenance is to be performed, the outlet in the back plate 4 is opened.

A solar battery 8 is mounted on the upper surface of the side portion 5. An electric double-layer capacitor 9 received in the indicator 1 is charged with electric power generated by the solar battery 8. The solar battery 8 has such a size as can be mounted on the indicator 1. The solar battery 8 is screwed to the indicator 1 at mount portions 8*a* formed in the solar battery 8. As shown in FIG. 2, the indicator 1 contains the electrical equipment portion 7 including, for example, an electric double-layer capacitor 9, a changeover switch 10, a control portion 11, light-emitting diodes (hereinafter referred to as "LEDs") 12, etc. The LEDs 12 are lighted by the electric power of the electric double-layer capacitor 9. The surface area of the solar battery 8 is designed on the basis of the capacity of the electric double-layer capacitor 9 used, the electric power consumed by the LEDs 12, and so on. In this embodiment, because only five LEDs 12 are used, consumed electric power is reduced so that the size of the solar battery 8 can be reduced.

The electric double-layer capacitor 9 is connected to the LEDs 12 through the changeover switch 10 to which also a photosensor 13 for detecting the intensity of light in the outside and the control portion 11 for controlling the turning-on/off of the respective LEDs 12 are connected. LEDs 12 to be continuously turned on and LEDs 12 to be intermittently turned on are set in the control portion 11 in advance, so that the light-emitting states of the respective LEDs 12 are controlled on the basis of this setting. This setting can be changed easily by a setting switch in the control portion 11.

The optical fibers 6 received in the indicator 1 are collected as bundles at one end so that the bundles are arranged so as to face the LEDs 12. The other ends of the optical fibers 6 are attached to the indication panel 3 so that light emitted by the turned-on LEDs 12 is transmitted through the optical fibers 6 to thereby light the one-end portions of the optical fibers 6 on the indication panel 3. The one-end portions of the optical fibers 6 are arranged so as to rim the characters of the indication panel 3 and the edge of the indication panel 3. In this embodiment, optical fibers 6 assigned to one character are collected as one optical fiber bundle so that the optical fiber bundle is lighted by one LED 12. That is, optical fibers 6 assigned to "S" are collected as one optical fiber bundle 6*a*, optical fibers 6 assigned to "T" are collected as one optical fiber bundle 6*b*, optical fibers 6 assigned to "O" are collected as one optical fiber bundle 6*c* and optical fibers 6 assigned to "P" are collected as one optical fiber bundle 6*d*. Further, optical fibers 6 assigned to the edge of the indication panel 3 are collected as one optical fiber bundle 6*e*. In total, five optical fiber bundles 6*a*, 6*b*, 6*c*, 6*d* and 6*e* are formed. The optical fiber bundles 6*a*, 6*b*, 6*c*, 6*d* and 6*e* correspond to the five LEDs 12 respectively.

The operation of the solar battery type self-light-emitting sign will be described below. First, electric power is generated by the solar battery 8 in the day so that the electric double-layer capacitor 9 is charged with the electric power. The photosensor 3 always detects the intensity of outside light so that the changeover switch 10 is turned on when the light intensity is not larger than a predetermined value because of the darkening of the outside. In this occasion, the electric power from the electric double-layer capacitor 9 is supplied to LEDs 12 through the changeover switch 10 so that the LEDs 12 are turned on. The LEDs 12 are controlled by the control portion 11 so as to be continuously or intermittently turned on on the basis of the light-emitting states of the LEDs 12 set in advance. When, for example, the characters "STOP" are to be continuously lighted and the edge portion of the indication panel 3 is to be intermittently lighted, LEDs 12 corresponding to the optical fiber bundles 6*a*, 6*b*, 6*c* and 6*d* are continuously turned on and an LED 12 corresponding to the optical fiber bundle 6*e* is intermittently turned on.

Although this embodiment shows the case where five LEDs are used, the number of LEDs can be determined desiredly in accordance with the number of optical fibers to be used. Roughly, about 75 optical fibers each having a diameter of 0.75 mm can correspond to one LED having a diameter of 10 mm. In the solar battery type self-light-emitting sign, the number of LEDs used can be reduced so that electric power consumed at the time of turning-on of LEDs can be saved. For example, a solar battery type self-light-emitting sign which must use 25 LEDs conventionally, can be realized by only five LEDs according to the present invention. Accordingly, the capacity of the solar battery can be reduced to ⅕. That is, electric power consumed by the solar battery type self-light-emitting sign can be saved, so that the size of the solar battery can be reduced.

This embodiment is configured so that one-end portions of optical fibers are arranged on the indicator and that light from LEDs turned on by electric power given from the electric double-layer capacitor is transmitted through the optical fibers. Accordingly, the indicator can be lighted by a small number of LEDs, so that electric power consumed at the time of turning-on the LEDs can be saved. Accordingly, because not only the size of the solar battery which is a power generating portion can be reduced but also the number of LEDs and the number of electric double-layer capacitors can be reduced, the cost of the solar battery type self-light-emitting sign can be reduced.

Further, the indicator is made hollow so that the electrical equipment portion is received within the indicator, and the small-sized solar battery is put on the upper surface of the indicator and united with the indicator into one body. Accordingly, because the weight of the solar battery type self-light-emitting sign can be reduced, on-site setting can be made easily.

Further, optical fiber bundles are provided respectively correspondingly to characters of the indicator and LEDs are provided respectively correspondingly to the optical fiber bundles. Accordingly, because the respective lighting states of the characters can be controlled by controlling the light-emitting states of the LEDs individually, continuous and intermittent turning-on states can be variously realized by a simple structure.

Embodiment 2

Embodiments 2-1 and 2-2 of the present invention will be described below with reference to FIGS. 3A through 3C and FIGS. 4A through 4E.

Figure 13:
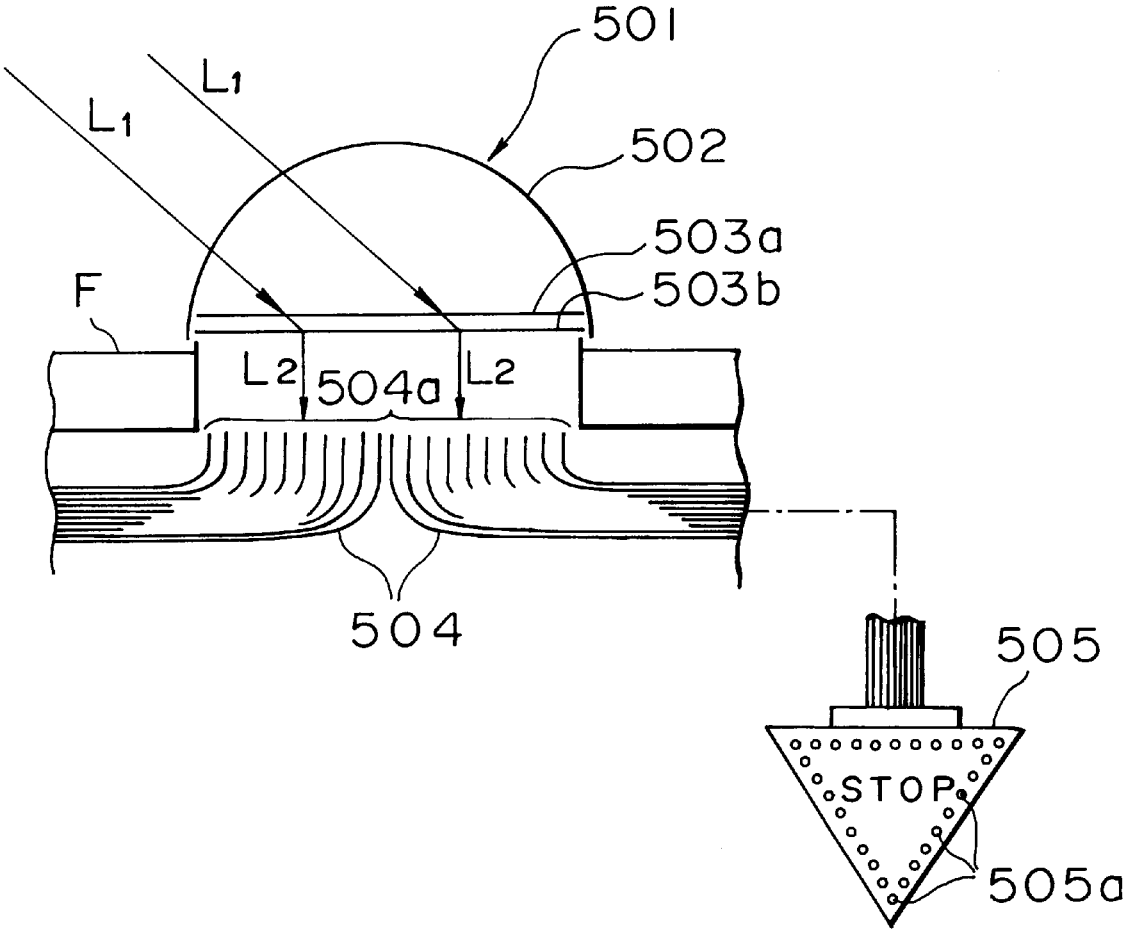
FIG. 13 PRIOR ART
FIG. 13 is a schematic front view showing the overall configuration of an indication apparatus using means for fixing optical fibers to the indicator and showing a conventional example and the Embodiment 2 of the present invention.
Figure 14:
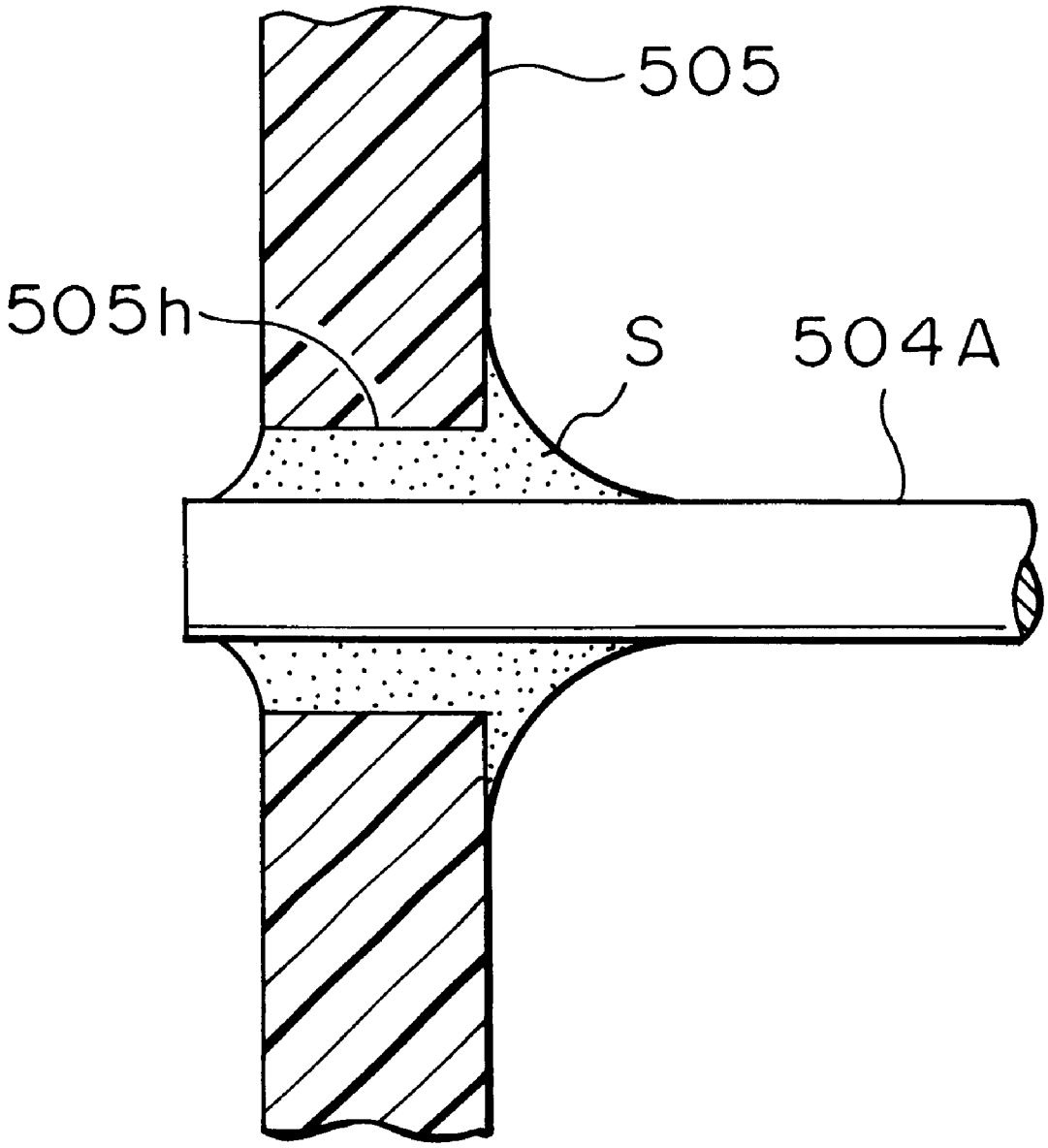
FIG. 14 PRIOR ART
FIG. 14 is a vertical sectional view showing an optical fiber-fixture and showing a conventional example.

Incidentally, because an indication apparatus to which Embodiment 2-1 or 2-2 is applied can be configured in the same manner as the conventional indication apparatus shown in FIG. 13, the description of the indication apparatus will be omitted. Further, it is a matter of course that the indication apparatus in this embodiment can be applied to the solar battery type indication apparatus shown in Embodiment 1 or to solar battery type indication apparatuses which will be described in Embodiments 3 to 7.

Embodiment 2-1

Figure 3A:
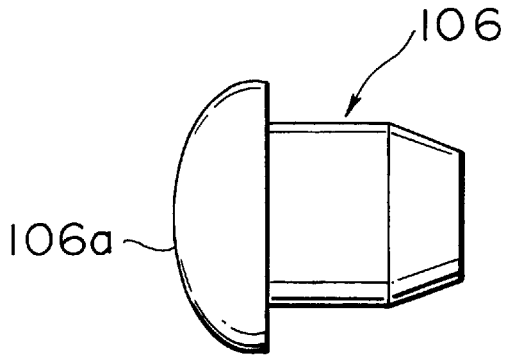
FIGS. 3A to 3C are views showing a fixture and the mounting configuration thereof and showing Embodiment 2-1 of the present invention, FIG. 3A being a front view of the fixture, FIG. 3B being a vertical sectional view of the fixture, FIG. 3C being a vertical sectional view showing a state in which an optical fiber is fixed to an indicator by using the fixture.
Figure 3B:
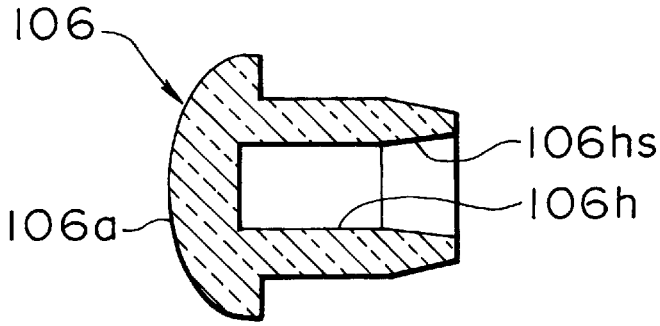
Figure 3C:
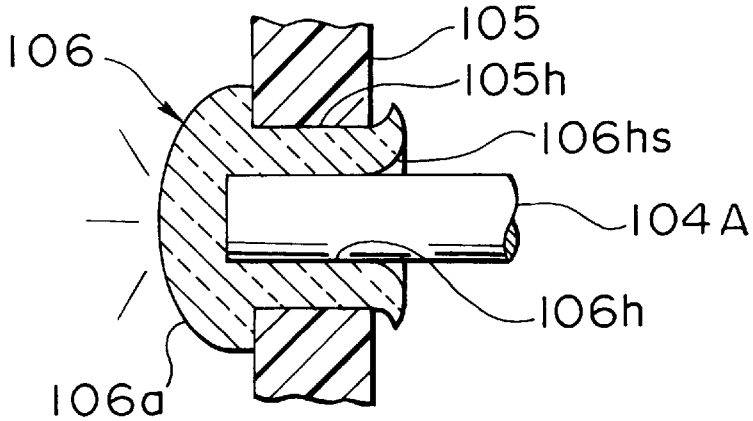

FIGS. 3A to 3C show Embodiment 2-1 of the present invention. In the drawings, FIG. 3A is a front view of a fixture in this embodiment, FIG. 3B is a vertical sectional view of the fixture, and FIG. 3C is a vertical sectional view showing a state in which one optical fiber is fixed to the indicator by using the fixture in this embodiment.

In FIGS. 3A to 3C, the reference numeral 106 designates an eyelet-shaped fixture in this embodiment. The fixture 106 is formed from an elastic material and has a curved-surface lens portion 106*a* formed at its end. As shown in FIGS. 3A to 3C, a fitting hole 106*h* for inserting an optical fiber 104A therein is provided in the center portion of the fixture 106.

The fitting hole 106*h* is designed so that an inclined surface 106*hs* is formed in the tail portion of the fixture 106 as the optical fiber 104 insertion side to widen the fitting hole 106*h* toward the tail portion side end of the fixture 106. It is preferable to form the inclined surface 106*hs* in an end portion of the fixture beyond the thickness portion of the indicator 105 as shown in FIG. 3C.

Further, mount holes 105*h* of the same number as the number of optical fibers 104A are formed in the indicator 105 for mounting respective fixtures 106.

Incidentally, an elastic resin material such as polycarbonate, polyamide, polyacetal, or the like, is suitable as the elastic material used for the fixture 106.

In the aforementioned configuration, the optical fibers 104A are fixed to the indicator 105 through the steps of: fitting the optical fibers 104A for transmitting light from a light source such as LEDs, a solar lighting apparatus, etc. into the mount holes 105*h* of the indicator 105 from the rear side (right side in FIG. 3B) of the indicator 105; inserting ends of the optical fibers into the fitting holes 106*h* of the fixture 106; and mounting the fixtures 106 into the mount holes 105*h* of the indicator 105 as shown in FIG. 3C.

Because an elastic material is used as each of the fixtures constituting an optical fiber fixing means in this embodiment as described above, when the fixtures 106 including the optical fibers fitted therein in advance are fixed to the indicator 105, the indicator 105 is sandwiched between the head portions of the fixtures 106 and the tail portions of the fixtures 106 widen by insertion of the respective ends of the optical fibers 104A as shown in FIG. 3C. Accordingly, a stopper function arises so that the optical fibers can be fixedly attached to the indicator mechanically easily.

Incidentally, in this case, when the fitting hole provided in each of the fixtures as shown in FIG. 3C is designed so that an inclined surface is formed toward the end of the tail portion of the fixture so as to outward widen the fitting hole, the tail portion of the fixture 106 including the optical fiber 104 inserted therein in advance as describe above is deformed so as to strike on the inner wall of the indicator. Accordingly, not only a stopper function arises but also a function of facilitating the work for fitting the fixture onto the optical fiber from the tail portion of the fitting hole is provided.

Further, because the lens portions 106*a* deformed are present at ends of the fixtures 106 so that light output from the ends of the optical fibers 104A fitted into the fixtures 106 is radiated to the outside while being diffused around by the lens portions 106*a*, the description on the indicator 105 can be recognized from the outside in a wide angle range.

Embodiment 2-2

Figure 4A:
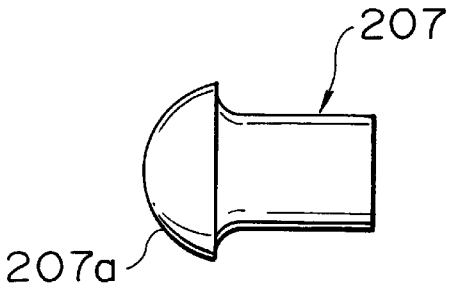
FIGS. 4A to 4E are views showing a fixture and the mounting configuration thereof and showing Embodiment 2-2 of the present invention, FIG. 4A being a front view of a lens body in the present invention, FIG. 4B being a vertical sectional view of the lens body, FIG. 4C being a front view of the fixture, FIG. 4D being a vertical sectional view of the fixture, FIG. 4E being a vertical sectional view showing a state in which an optical fiber is fixed to the indicator by using the lens body and the fixture in the present invention.
Figure 4B:
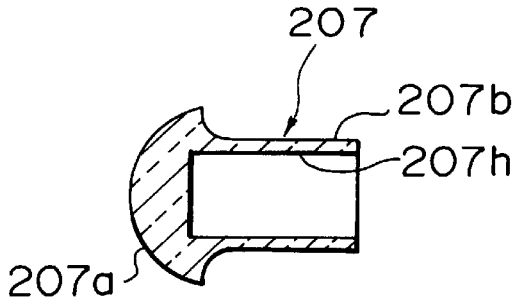
Figure 4C:
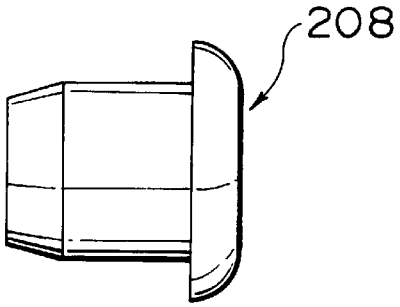
Figure 4D:
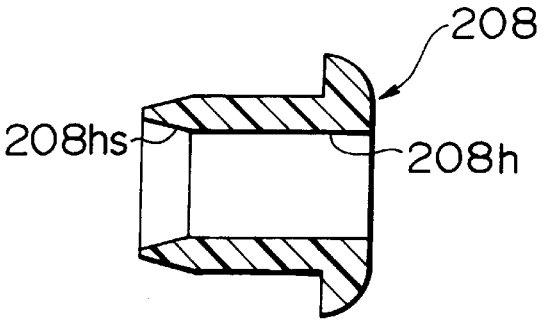
Figure 4E:
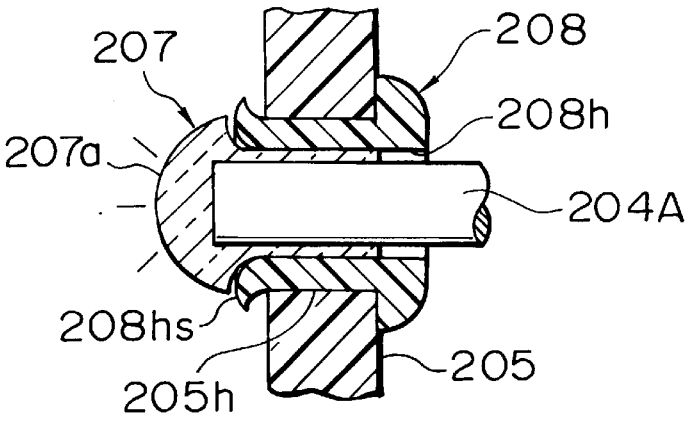

FIGS. 4A to 4E show Embodiment 2-2 of the present invention. In the drawings, FIG. 4A is a front view of a lens body in this embodiment, FIG. 4B is a vertical sectional view of the lens body, FIG. 4C is a front view of a fixture in this embodiment, FIG. 4D is a vertical sectional view of the fixture, and FIG. 4E is a vertical sectional view showing a state in which one optical fiber is fixed to the indicator by using the lens body and fixture in this embodiment.

In FIGS. 4A to 4E, the reference numeral 207 designates a lens body in the present invention. As shown in FIGS. 4A to 4E, the lens body 207 has a curved-surface lens portion 207*a* formed at its end, a trunk portion 207*b,* and an insertion hole 207*h* provided in a range of from the tail portion of the lens body 207 to the rear of the lens portion 207*a* so that an optical fiber 204A is inserted in the insertion hole 207*h* in the direction of the length of the trunk portion 207*b* of the lens body and in the center of the trunk portion 207*b*.

The reference numeral 208 designates an eyelet-like fixture of the present invention which is formed from an elastic material. A through-hole 208*h* in which the trunk portion 207*b* of the lens body 207 is to be passed is provided in the center portion of the fixture 208.

As shown in FIGS. 4A to 4E, preferably, the through-hole 208*h* is designed so that an inclined surface 208*hs* is formed so as to outward widen the through-hole 208*h* toward the tail portion side end of the fixture 208 which is the lens body 207 insertion side. In this case, preferably, the inclined surface 208*hs* is formed in the tail side end portion beyond the thickness portion of the indicator 205 as shown in FIG. 4E.

Incidentally, mount holes 205*h* of the same number as the number of optical fibers 204A are formed in the indicator 205 in order to mount respective fixtures 208.

An elastic resin material such as Nylon, polycarbonate, polyamide, polyacetal, or the like, is suitable as the elastic material for the fixture 208.

In the aforementioned configuration, the optical fibers 204A are fixed to the indicator 205 through the steps of: fitting the fixtures 208 into the mount holes 205*h* of the indicator 205 from the tail portion side of the fixtures 208 so that the inner surface side of the head portions of the fixtures 208 strikes on the rear side of the indicator 205 as shown in FIG. 4E; inserting the optical fibers 204A into the through-holes 208*h* of the fixtures 208 from the rear side of the indicator 205 (the head portion side of the fixtures 208); fitting the ends of the optical fibers 204A into the fitting holes 207*h* of the lens bodies 207 to make the ends of the optical fibers 204A face the lens portions 207*a;* and fitting the lens bodies 207 into the through-holes 208*h* of the fixtures 208 so that the lens portions 207*a* come to the front surface side of the indicator 205.

Because an elastic material is used as each of the fixtures constituting an optical fiber fixing means in this embodiment as described above, when the optical fibers 204A are fixed to the indicator 205 through the above-mentioned steps, the indicator 205 is sandwiched between the head portions of the fixtures 208 and the tail portions of the fixtures 208 which is deformed to be warped outward by the insertion of the lens portions 207 as shown in FIG. 4E. Accordingly, a stopper function arises so that the optical fibers 204A can be fixedly attached to the indicator 205 mechanically easily.

Further, if inclined surfaces 208*hs* are formed in the through-holes 208*h* of the fixtures 208 as shown in FIG. 4C, not only a stopper function arises on the basis of the head portions and tail portions of the fixtures 208 but also a function of facilitating the work for fitting the lens bodies onto the optical fibers 204A from the tail portion side of the through-holes 208*h* is provided.

Although the aforementioned embodiments have been described upon the case where light rays such as sunlight, or the like, are transmitted through optical fibers so as to be radiated onto the notice described on the indicator as shown in FIG. 13, the indication apparatus of this embodiment can be applied to an indication apparatus which is configured so that a plurality of optical fibers are used as pixels constituting the description such as "STOP", or the like.

The indication apparatus of this embodiment configured as described above has the following excellent effects.

First, in Embodiment 2-1, the optical fibers are fixed to the indicator through the steps of: fitting the optical fibers into the mount holes of the indicator to put the ends of the optical fibers into the fitting holes of the fixtures; and then fitting the fixtures into the mount holes of the indicator to fix the optical fibers to the indicator. In Embodiment 2-2, the optical fibers are fixed to the indicator through the steps of: fitting the fixtures into the mount holes of the indicator to put the head portions on the rear surface side of the indicator; inserting the optical fibers into the through-holes of the fixtures from the rear surface side of the indicator; fitting the ends of the optical fibers into the fitting holes of the lens bodies to make the ends of the optical fibers face the lens portions; and fitting the lens bodies into the through-holes of the fixtures so that the lens portions come to the front surface side of the indicator. Accordingly, in the respective embodiments, the optical fibers can be fixed to the indicator mechanically, so that scattering in position and direction of fixing the optical fibers to the indicator is prevented from occurring depending on the worker.

In Embodiment 2-1, the end of each of the fixtures is shaped like a lens. In Embodiment 2-2, lens bodies are provided in the tail portion side of the fixtures separately from the fixtures. Accordingly, light outputted from the optical fibers is radiated to the outside while being diffused through the lens portions. Accordingly, light from LEDs, or the like, is transmitted through the optical fibers, so that light outputted from the ends of the optical fibers is diffused in a wide range through the lens portions of the lens bodies. Accordingly, the description on the indicator can be recognized from the outside in a wide angle range even in the case where the indicator is in a dark place.

When an inclined surface is formed in a fitting hole provided in each of fixtures so as to widen the fitting hole toward the tail portion side end of the fixture as shown in Embodiment 2-1, not only the work of inserting the optical fiber into the fixture from the tail portion side of the fitting hole of the fixture is facilitated but also a stopper function arises to fasten the fixture because the indicator is sandwiched between the rear surface side of the head portion of the fixture and the tail portion of the fixture widened by the insertion of the optical fiber into the fixture.

When an inclined surface is formed in a through-hole provided in each of fixtures so as to widen the through-hole toward the tail portion side end of the fixture as shown in Embodiment 2-2, not only the work of inserting the lens body from the tail portion side of the through-hole is facilitated but also a stopper function arises to fasten the fixture because the indicator is sandwiched between the rear surface side of the head portion of the fixture and the tail portion of the fixture widened by the insertion of the lens body into the fixture.

As described above, in the fixtures according to the present invention, since the optical fibers can be fixed to the indicator mechanically, easily and instantaneously through the elastic materials, workability is improved greatly.

Furthermore, since an elastic material is used as each of the fixtures, the deformation of the fixtures required at the fixing work is performed easily.

Furthermore, when the optical fibers are fixed to the indicator by means of the fixtures according to the present invention, conventional deterioration due to an adhesive agent is prevented so that the life of fixing is elongated.

Embodiment 3

Embodiment 3 of the present invention will be described below with reference to FIGS. 5 through 12.

Figure 5:
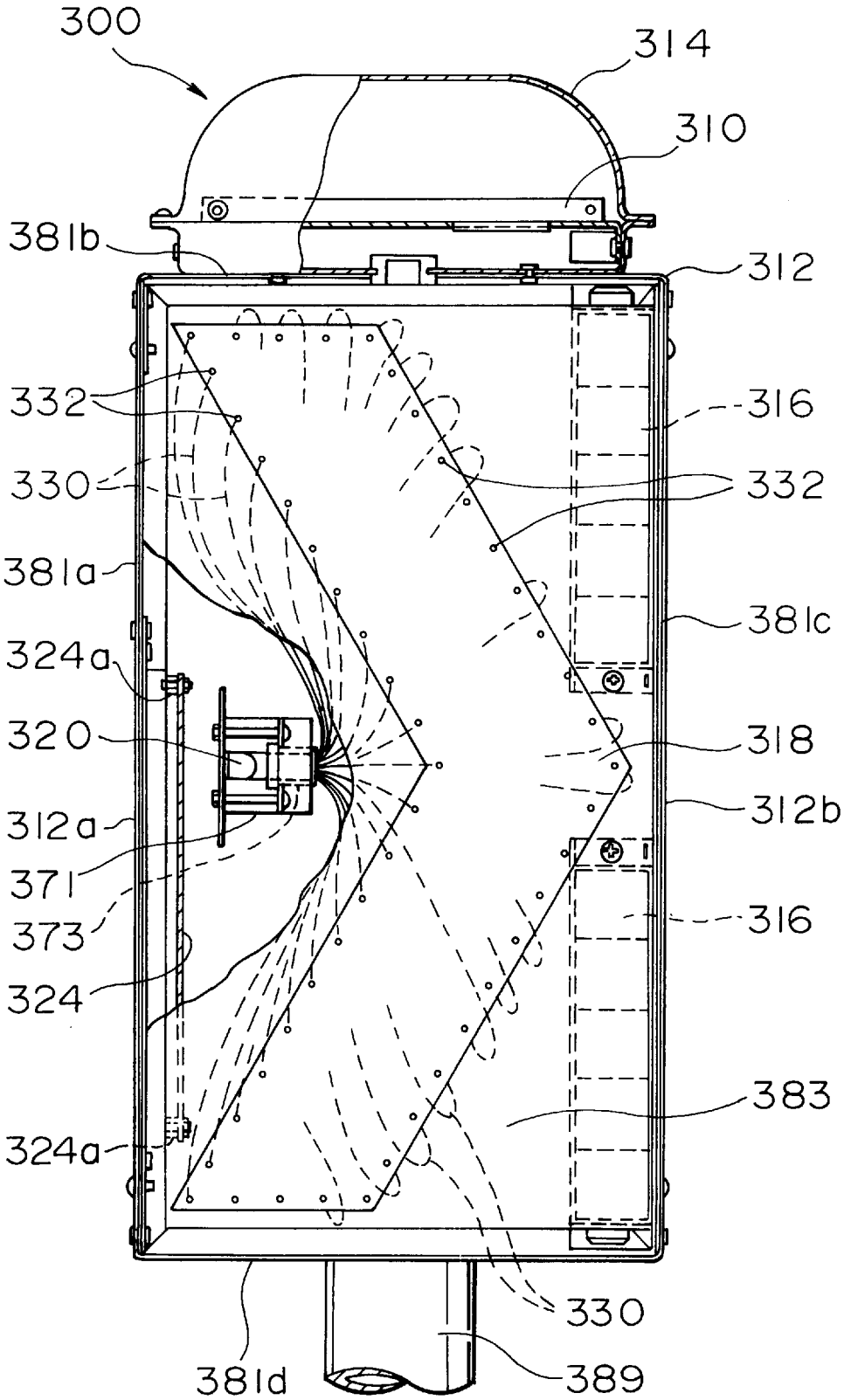
FIG. 5 is a front view showing Embodiments 3 to 7 of the present invention.

FIG. 5 shows the configuration of an indication unit 300 in which a solar battery 310 is provided. The solar battery 310 is disposed on the upper portion of an indication apparatus body 312 so as to be able to receive sunlight efficiently. The solar battery 310 is put in a transparent light-receiving portion casing 314 so as to be protected from dust, wind and rain.

Figure 6:
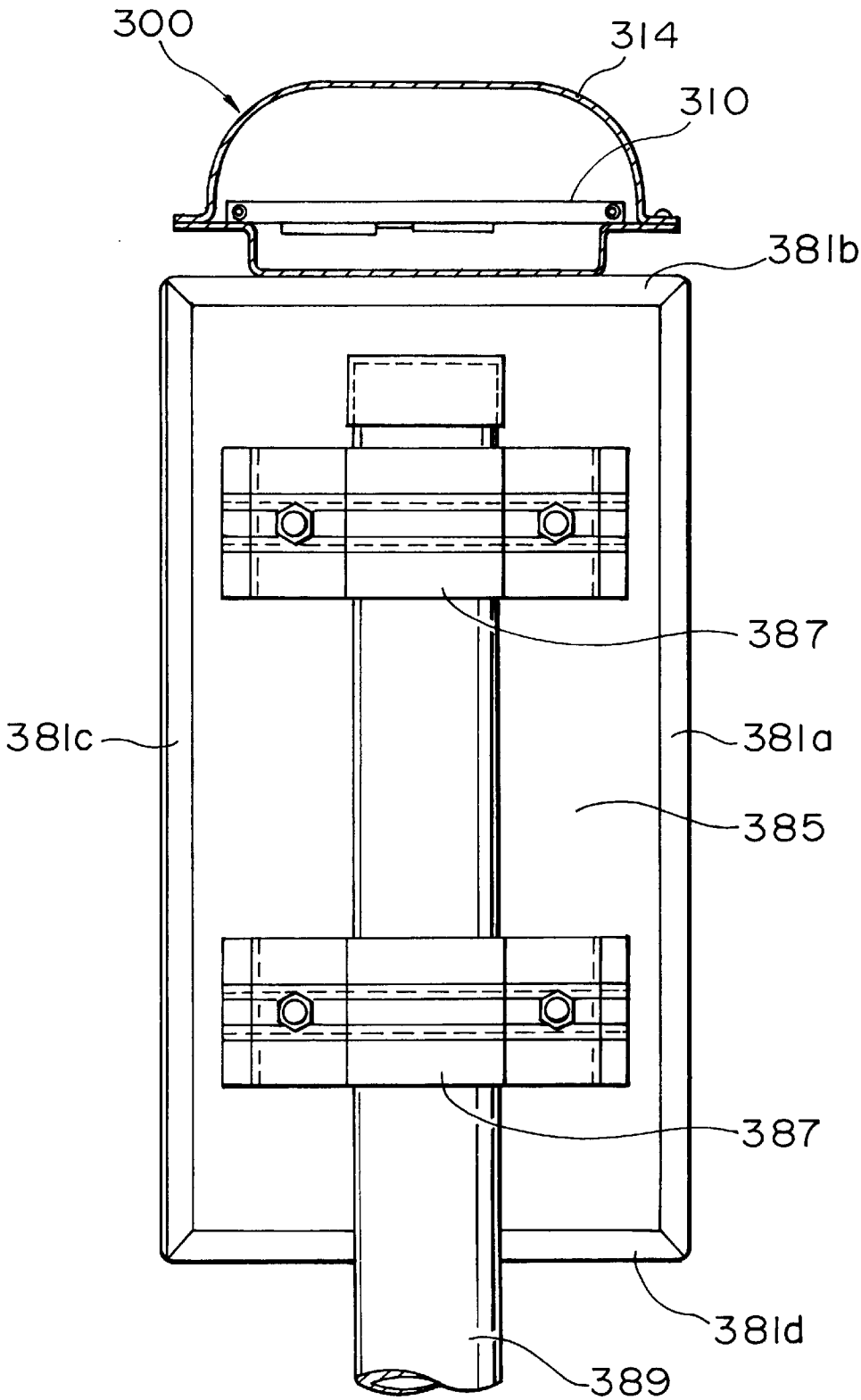
FIG. 6 is a back view showing the Embodiments 3 to 7 of the present invention.
Figure 7:
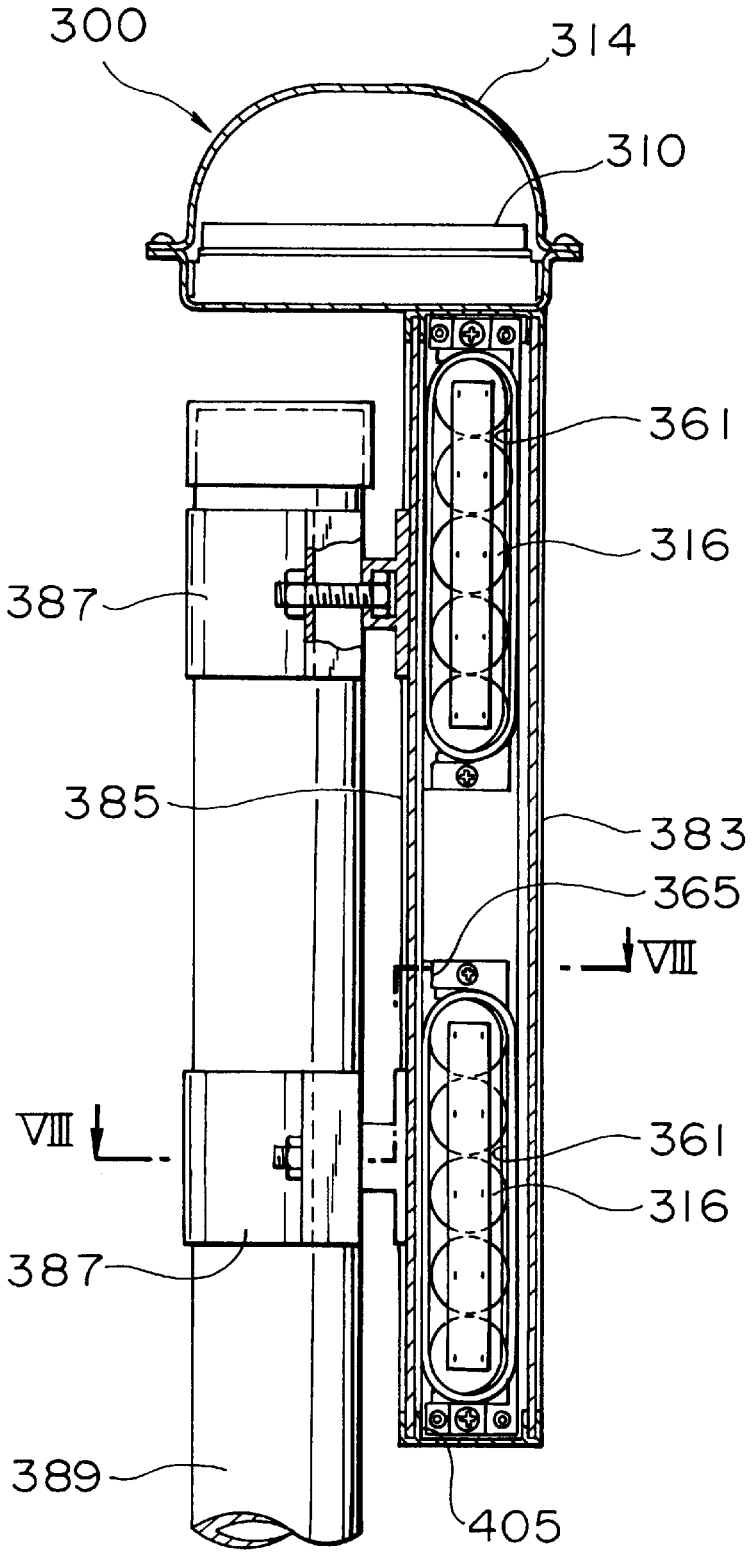
FIG. 7 is a side view showing the Embodiments 3 to 7 of the present invention.
Figure 8:
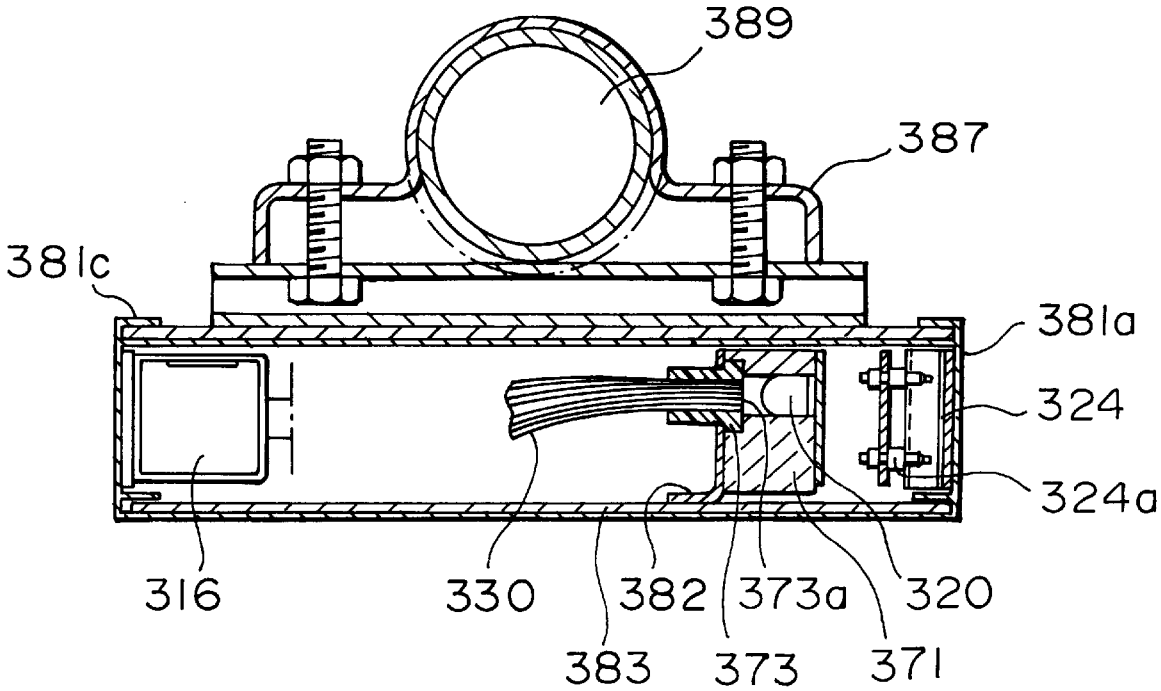
FIG. 8 is a cross-sectional view along VII-VIII line in FIG. 7, showing the Embodiments 3 to 7 of the present invention.

The indication apparatus body 312 is shaped like a box having four side walls 381*a* to 381*d* made of aluminum. The front surface portion of the indication apparatus body 312 is formed from a sign panel portion 383 of a resin, and the rear surface portion is formed from a rear surface panel portion 385 of aluminum as shown in FIGS. 6 and 7. Hook holders 387 are provided on the rear surface panel portion 385. For example, a guide post or pole 389 provided on the road is inserted into the hook holders 387. As shown in FIG. 5, the indication apparatus body 312 contains a control substrate 324, capacitors 316 capable of accumulating electric power generated by the solar battery 310, a light-emitting diode (LED) 320 for emitting light in response to the generated electric power, a sign portion 318 for leading light from the LED 320 to light-emission ends 332 through optical fibers 330 to form a predetermined sign.

In this embodiment, the respective parts 316, 318, 320 and 324 are arranged in the order of the control substrate 324, the LED 320, the sign portion 318 and the capacitors 316 from one side portion 312*a* of the indicator apparatus body 312 to the other side portion 312*b*.

For example, an electric double-layer capacitor can be used as the capacitor 316. The electric double-layer capacitor is a secondary battery which is not only long in its life because there is no chemical change but also excellent in the handling property because the voltage thereof is relatively high and stable.

The aforementioned control substrate 324 is fixed to the inner surface of one side wall 381*a* of the indication apparatus body 312 through electrically insulating bolts 324*a*.

Figure 9:
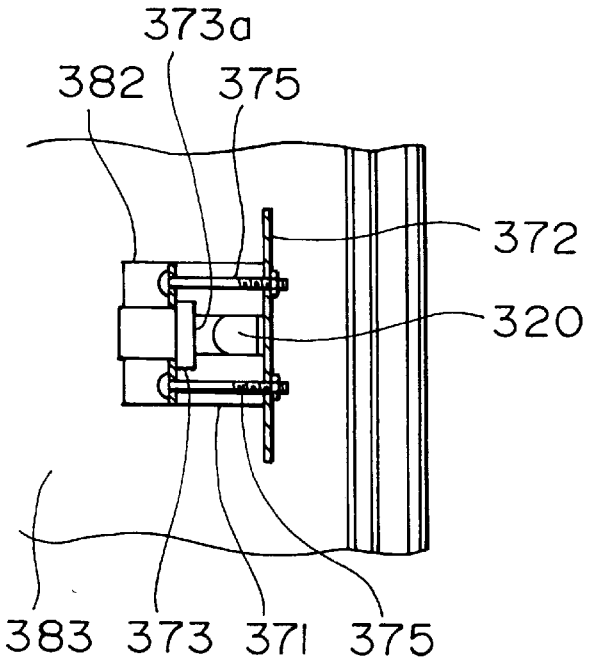
FIG. 9 is a front view showing a mounting state of a light emitter and showing the Embodiments 3 to 7 of the present invention.
Figure 10:
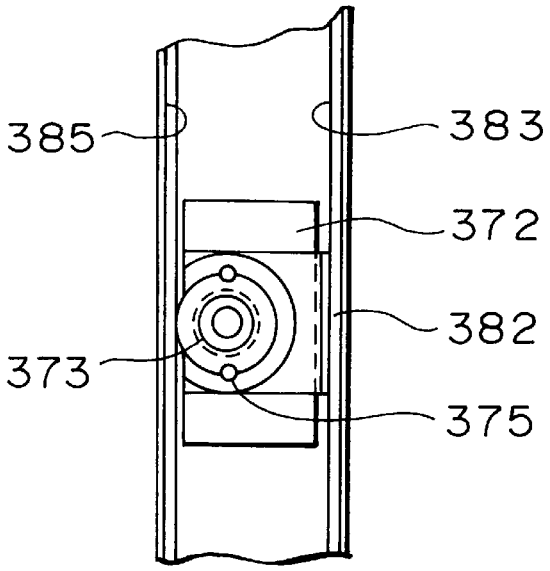
FIG. 10 is a front view showing a mounting state of the light emitter and showing the Embodiments 3 to 7 of the present invention.

As shown in FIGS. 8 through 12, the aforementioned LED 320 is provided in the vicinity of the control substrate 324. The LED 320 is fixed to the sign panel portion 383 after being attached onto a mount 371. That is, an L-shaped holder 382 is fixed to the sign panel portion 383 by an adhesive agent and backed with the mount 371 and a support plate 372 for holding the LED 320. As shown in FIG. 9, these L-shaped holder 382, mount 371 and support plate 372 are connected to each other by two bolts 375. An optical fiber bundle 373 obtained by bundling a large number of optical fibers 330 at one end is attached to the mount 371.

The optical fiber bundle 373 is disposed between the holder 382 and the mount 371 so as to be rotatable. In this configuration, the optical fiber bundle 373 can be rotated in an arbitrary direction, so that the optical fibers 330 are distributed easily.

A light input end 373*a* of the optical fiber bundle 373 is inserted into the mount 371 so as to face the light-emission surface of the LED 320. The other ends of the optical fibers 330 extended from the optical fiber bundle 373 are attached, by an adhesive agent, respectively to the light-emission ends 332 which show the contour (arrow) of the sign portion 318. The light-emission ends 332 are light output ends of the optical fibers 330, and, specifically, holes formed in the sign panel portion 383.

The sign on the sign portion 318 is formed to a desired shape (for example, road sign) in accordance with the requirement. In FIG. 5, the sign is an "arrow" type sign.

The optical fiber bundle 373 is arranged substantially in the center of the sign (arrow) in the sign portion 318. If the optical fiber bundle 373 is arranged at the edge of the sign in the sign portion 318 like in the prior art, the distances between the optical fiber bundle 373 and the light-emission ends 332 of the sign portion 318 vary so that a value not smaller than the allowed curvature (R) of the optical fibers 330 defined on the basis of the diameter of the optical fibers 330 cannot be secured at the time of distribution of the optical fibers 330 to thereby make the bending of the optical fibers 330 uneven.

In this embodiment, because the optical fiber bundle 373 is arranged substantially in the center of the sign (arrow), extremely long optical fibers and extremely short optical fibers are not required to be prepared as the optical fibers 330 connected to the light-emission ends 332 respectively. Accordingly, the bending of the optical fibers 330 is made substantially even at the time of distribution of the optical fibers 330, so that a good distributing condition is obtained. Furthermore, because a value of curvature (R) of the optical fibers 330 not smaller than the allowed value defined on the basis of the diameter of the optical fibers 330 can be secured, light transmission through the optical fibers 330 is performed substantially securely so that the sign in the sign portion 318 is indicated accurately.

Figure 11:
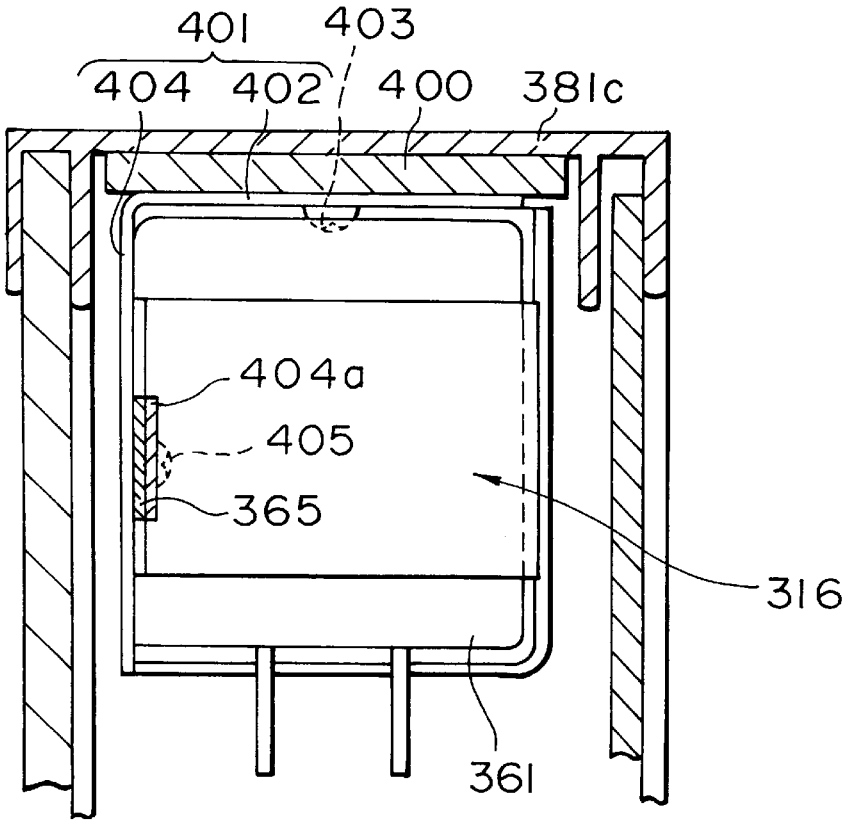
FIG. 11 is a front view showing a mounting state of a capacitor and showing the Embodiments 3 to 7 of the present invention.

As shown in FIGS. 5, 7 and 11, five relatively large-size capacitors 316 are collectively put in each of two receiving holders 361. These receiving holders 361 are attached to the inner surface side of the other side wall 381*c* of the indication apparatus body 312. That is, the reference numeral 400 designates a fixing plate fixed to the inner side of the side wall 381*c* by a rivet (not shown); and 401, an L-shaped fitting having one portion 402 fixed to the fixing plate 400 by a screw 403 and the other portion 404 on which the capacitor 316 is put. The capacitor 316 is fixed by the receiving holder 361. The receiving holder 361 has a pawl member 365 provided at one end for holding the capacitor 316, and a fitting member provided at the other end so as to be attached to the other portion 404 of the fitting 401 by means of a screw 405 shown in FIG. 7. The reference numeral 404*a* designates an erected portion which is formed on the other portion 404 so as to be engaged with the aforementioned pawl member 365.

An example of a system in which a plurality of indication units 300 are used in combination so that the respective indication units are interlocked with each other to perform a predetermined indication will be described below with reference to FIG. 12.

Figure 12:
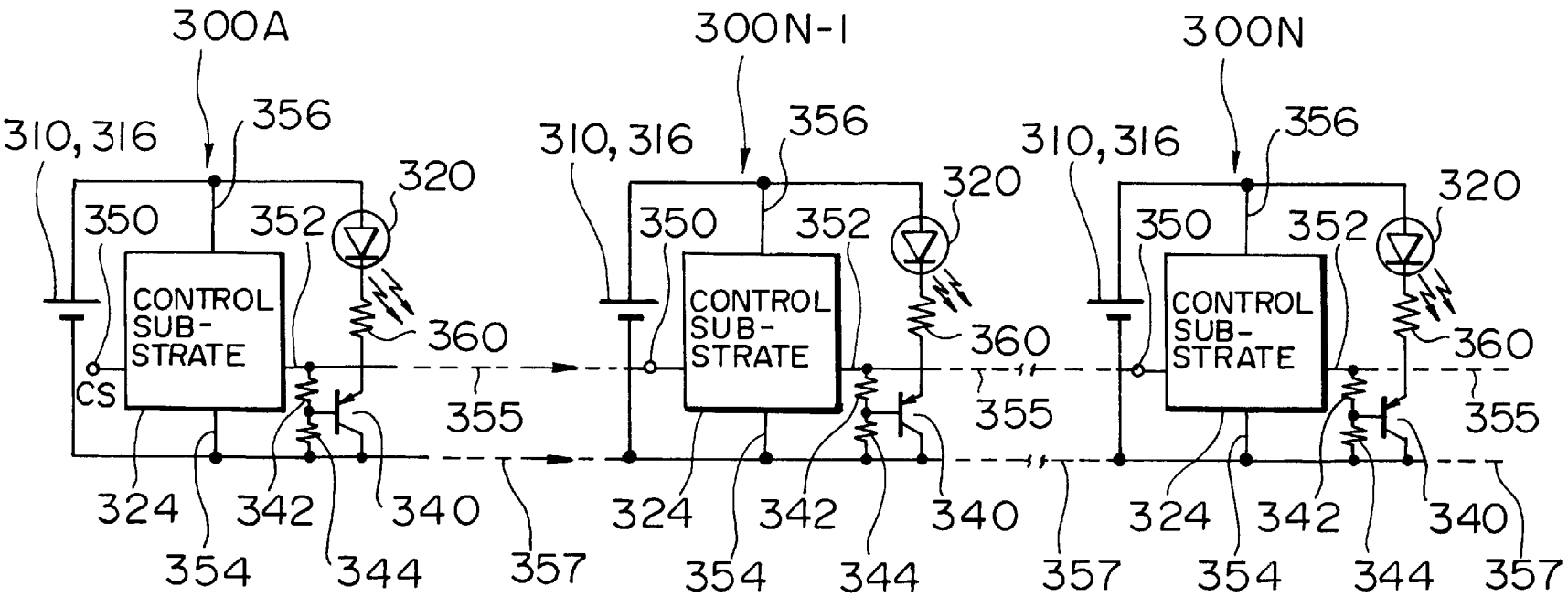
FIG. 12 is an electrical connection circuit diagram of an indication unit showing the Embodiments 3 to 7 of the present invention.

In this system example, a plurality of indication units 300A to 300N are arranged side by side, for example, in a rightward direction in FIG. 12. The indication units 300A to 300N are interlocked so as to be lighted successively, so that a light flow is formed so as to be indicated on the sign portion 318. As a result, configuration is made so that, for example, the state of movement on the road, that is, the presence of a curve can be recognized by eyes or driver's attention can be drawn to the road under construction.

Each of control substrates 324 in the indication units 300A to 300N has interlock control connection terminals 350, 352, 354 and 356. Through the connection terminals 352 to 356 and signal wirings 355 (hot side) and 357 (GND side), an interlock command signal CS is transmitted from the control substrate 324 of the prior-stage indication unit 300A to the control substrate 324 of the past-stage indication unit 300N in the manner of a relay successively.

The connection terminals 354 and 356 are connected to a solar battery 310 including a capacitor 316. The terminal 356 is connected to an LED 320. The terminals 352 and 254 are connected to the base of an LED-driving transistor 340 through voltage-dividing resistors 342 and 344. The emitter of the transistor 340 is connected to the LED 320 through a resistor 360. The collector of the transistor 340 is connected to an electric wiring portion 357.

In each control substrate 324, the capacitor 316 is charged with electric power generated by the solar battery 310 in the day (sunlight-receiving period) and the electric power accumulated in the capacitor is supplied to the LED 320 to perform light emission in the night (sunlight-not-receiving period).

The interlocking operation will be described below.

First, when an interlock command signal is given to the terminal 350 of the leftmost indication unit 300A, the control substrate 324 turns on the transistor 340 so that electric power accumulated in the capacitor 316 is supplied to the LED 320 to perform light emission. The light emitted by the LED 320 is transmitted to the light-emission end 332 of the sign portion 318 through the optical fiber 330, so that indication is performed to rim the sign portion 318.

At the point of time when the operation of lighting the first indication unit 300A is terminated as described above, an interlock command signal CS for interlocking operation is transferred from the terminals 352 and 354 of the control substrate 324 of the first indication unit 300A to the terminals 350 and 354 of the control substrate 324 of the second indication unit 300B (not shown). On the basis of the interlock command signal CS, electric power accumulated in the capacitor 316 is supplied to the LED 320 by the control substrate 324 of the second indication unit 300B, so that the light-emission end 332 of the sign portion 318 is lighted through the optical fiber 330.

Then, at the point of time when light emission at the light-emission end 332 of the sign portion 318 in the second indication unit 300B is terminated, an interlock command signal CS is transferred from the terminals 352 and 354 of the control substrate 324 of the second indication unit 300B to the terminals 350 and 354 of the control substrate 324 of the third indication unit 300C.

Thereafter, the same control as described above is performed up to the last indication unit 300N on the basis of the interlock command signal CS to perform light emission at the light-emission ends 332 of the sign portions 318 in the indication units successively so that, for example, an arrow-shaped light flow can be indicated.

Incidentally, it is possible in this embodiment that the aforementioned series of operation may be repeated as one cycle per predetermined period of time.

In short, in this embodiment, because bundle portions 322 of optical fibers 330 connected to light emitters 320 are arranged substantially in the center of the sign in the sign portion 318, the distances between the bundle portions 322 and the light-emission ends 332 of the sign portion 318 are substantially equalized. Accordingly, a good distributing condition is obtained, so that distributing work is performed easily.

As described above, according to the present invention, because bundle portions of optical fibers connected to light emitters are arranged substantially in the center of the sign in the sign portion, the distances between the bundle portions and the light-emission ends of the sign portion are substantially equalized even in the case where the shape of the sign becomes complex. Accordingly, a good distributing condition is obtained. Furthermore, because a value of curvature (R) not smaller than its allowed value defined on the basis of the diameter of the optical fibers is secured, light transmission through the optical fibers is performed securely so that the sign is indicated accurately.

Embodiment 4

Embodiment 4 of the present invention will be described below with reference to FIGS. 5 through 12.

Incidentally, because the configuration of Embodiment 4 is the same as that of Embodiment 3, only the operation and effect of Embodiment 4 will be described.

Because the optical fiber bundles 373 are arranged substantially in the center of the sign (arrow), extremely long optical fibers and extremely short optical fibers are not required to be prepared as the optical fibers 330 connected to the light-emission ends 332 respectively. Accordingly, a good distributing condition is obtained.

In this embodiment, control substrates 324 are fixed to one side wall 381*a* of the indication apparatus body 312, capacitors 316 as large-size parts are fixed to the other side wall 381*c* of the indication apparatus body 312, light emitters 320 are provided in the center of the indication apparatus body 312 near the control substrates 324, and a sign portion 318 forming a predetermined sign is put substantially in the center portion of the indication apparatus body 312 with enough space so as to easily receive the optical fibers 330 extended from the light emitters 320. Accordingly, various parts including a large number of optical fibers 330 are put in the indication apparatus body efficiently.

As described above, in this embodiment, because the control substrates, the light emitters, the indication portion and the capacitors are received in the indication apparatus body with enough space so as to be arranged in the order of from one side to the other side, various parts including a large number of optical fibers can be received in the indication apparatus body efficiently.

Embodiment 5

Embodiment 5 of the present invention will be described below with reference to FIGS. 5 through 12.

Incidentally, because the configuration of Embodiment 5 is the same as that of Embodiment 3, only the operation and effect of Embodiment 5 will be described.

Because the optical fiber bundles 373 are arranged substantially in the center of the sign (arrow), extremely long optical fibers and extremely short optical fibers are not required to be prepared as the optical fibers 330 connected to the light-emission ends 332 respectively. Accordingly, binding of the optical fibers 330 is made substantially uniform at the time of distribution of the optical fibers 330, so that a good distributing condition is obtained.

In this embodiment, the light-emission ends 332 of the sign portion 318 and the light emitters 320 are put on one and the same sign panel 383. Accordingly, the sign panel portion 383 can be assembled to the side walls 381*a* to 381*d* of the indication apparatus 312 in a state in which the light-emission ends are connected to the light emitters 320 through the optical fibers 330.

In this embodiment, it is possible to eliminate the conventional troublesome work of connecting the one-end portions of the optical fibers to the light emitters provided in a side wall of the apparatus body, assembling the sign panel portion to the side wall and connecting the other end portions of the optical fibers to the light-emission ends of the sign panel portion. Accordingly, the work of distribution of the optical fibers 330 is performed easily.

As described above, in this embodiment, because the light-emission ends of the sign portion and the light emitters are put on one and the same sign panel, the indication apparatus can be assembled through the steps of: connecting the light-emission ends and the light emitters by the optical fibers on the sign panel portion; and assembling the sign panel portion to the side wall of the indication apparatus body in a state in which the light-emission ends and the light emitters are connected. Accordingly, the work of connecting the optical fibers is performed easily compared with the prior art.

Embodiment 6

Embodiment 6 of the present invention will be described below with reference to FIGS. 5 through 12.

Incidentally, because the configuration of Embodiment 6 is the same as that of Embodiment 3, only the operation and effect of Embodiment 6 will be described.

The optical fiber bundles 373 are arranged substantially in the center of the sign (arrow) in the sign portion 318. If the optical fiber bundles 373 are arranged on the edge of the sign in the sign portion 318 like in the prior art, the distances between the optical fiber bundles 373 and the light-emission ends 332 of the sign portion 318 vary. In this embodiment, because the optical fiber bundles 373 are arranged substantially in the center of the sign (arrow), extremely long optical fibers and extremely short optical fibers are not required to be prepared as the optical fibers 330 connected to the light-emission ends 332 respectively. Accordingly, a good distributing condition is obtained.

As shown in FIGS. 5, 7 and 11, five relatively large-size capacitors 316 are collectively put in each of two receiving holders 361. These receiving holders 361 are attached to the inner surface side of the other side wall 381*c* of the indication apparatus body 312. That is, the reference numeral 400 designates an L-shaped fitting having one portion 402 fixed to a fixing plate by a screw 403 and the other portion 404 on which the capacitors 316 are put. The capacitors 316 are fixed by the receiving holders 361. Each of the receiving holder 361 has a pawl member 365 provided at one end for holding the capacitors 316, and a fitting member attached to the other portion of the fitting 401 by a screw 405 shown in FIG. 7. The reference numeral 404*a* designates an erected portion which is formed in the other portion so as to be engaged with the pawl member.

When the capacitors 316 are fixed by the receiving holders 361 and fixed to the aluminum side wall 381*c* side, the large-size and heavy-weight capacitors 316 can be supported to the indication apparatus body 312 securely.

In this embodiment, because control substrates 324 are fixed to the inner surface of one side wall 381*a* of the indication apparatus body 312 in an electrically insulated state, the control substrates 324 are not located in the center portion of the indication apparatus body 312. Accordingly, the control substrates 324 become no hindrance to the work of distributing the optical fibers 330. Further, because the receiving holders 361 for receiving the capacitors 316 are provided on the inner surface of the other side wall 381*c* of the indication apparatus body 312, the capacitors 316 are entirely contained in the receiving holders 361. Accordingly, there arises also an effect that the capacitors do not hinder to the work of distributing the optical fibers 330. In any case, the efficiency of storing parts in the indication apparatus body 312 can be improved.

According to the present invention, because the control substrates are fixed to the inner surface of one side wall of the indication apparatus body in an electrically insulated state, the control substrates are not located in the center portion of the indication apparatus body. Accordingly, the control substrates do not hinder to the work of distributing the optical fibers. Furthermore, because the receiving holders for receiving the capacitors are provided on the inner surface of the other side wall of the indication apparatus body, the capacitors are entirely contained in the receiving holders. Accordingly, the capacitors become no hinderance to the work of distributing the optical fibers.

In addition, the efficiency of storing parts in the indication apparatus body can be improved compared with the prior art.

Embodiment 7

Embodiment 7 of the present invention will be described below with reference to FIGS. 5 through 12.

Incidentally, because the configuration of Embodiment 7 is the same as that of Embodiment 3, only the operation and effect of Embodiment 7 will be described.

If the optical fiber bundle 372 attached to the mount 371 is not rotatable, a large number of optical fibers 330 cross each other at the time of distributing the optical fibers 330 to cause such a trouble that the optical fibers 330 are entangled.

In this embodiment, the optical fiber bundle 373 obtained by bundling a large number of optical fibers 330 is attached to the mount 371 so as to be rotatable. Because the optical fibers 330 connected to the light-emission ends 332 of the sign portion 318 are bundled as the optical fiber bundle 373 before the optical fiber bundle 373 is attached to the mount 371 so as to be rotatable, the optical fiber bundle after attachment is rotatable. Accordingly, the optical fibers 330 do not cross each other, so that it is possible to prevent such a trouble that the optical fibers are entangled with each other.

Although the aforementioned embodiment has shown the case where only the optical fiber bundle 373 is formed rotatably, it is a matter of course that the present invention is not limited thereto and that the present invention may be applied, as another embodiment, to the case where the mount 371 inclusive of the light emitters 320 is designed rotatably as a whole.

As described above, in this embodiment, because the optical fibers for connecting the light emitters and the light-emission ends of the sign portion are bundled as a bundle portion and then at least the bundle portion is formed so as to be rotatable, the bundle portion is rotatable even after attached. Accordingly, the optical fibers slightly cross each other, it is possible to prevent such a trouble that the optical fibers are entangled with each other. Accordingly, the work of connecting the optical fibers can be performed easily.

What is claimed is:

1. A solar battery indication apparatus comprising:

a body having a sign panel;

a solar battery:

light emitters configured to emit light in response to electric power generated by said solar battery, said light emitters being attached to said sign panel and disposed in a mount attached to said sign panel by a holder;

optical fibers configured to channel said light emitted by said light emitters to a sign portion of said sign panel configured to form a sign, and a binding portion configured to bind said optical fibers, said binding portion being disposed in said mount and substantially in a center of the sign, whereby the curvature of each of the optical fibers is greater than a value necessary to ensure accurate light transmission through each of said optical fibers, wherein said binding portion is secured so as to be rotatable.

2. A solar battery indication apparatus according to claim 1, wherein the sign portion is V-shaped.

3. An indication apparatus comprising:

light-emitting diodes, a display panel configured to display an indication and defining mount holes, optical fibers configured to transmit light from said light-emitting diodes to the display panel, fixtures respectively having through-holes and being equal in number to said optical fibers; and lens bodies respectively having lens portions at one end of each of said lens bodies and respectively having trunk portions defining optical fiber-fitting holes, said lens bodies being equal in number to said optical fibers;

wherein said fixtures are fitted respectively into said mount holes so that head portions of said fixtures are on a rear surface side of said display panel, and said optical fibers are inserted respectively into said through-holes of said fixtures, wherein ends of said optical fibers are fitted into respective said optical fiber-fitting holes of said lens bodies so as to face said lens portions and said lens bodies are fitted respectively into said through-holes of said fixtures so that said lens portions are disposed on a front surface side of said display panel, wherein each of said through-holes of said fixtures comprises an inclined surface.

4. An indication apparatus according to claim 3, wherein said fixtures comprise an elastic material.

* * * * *

UNITED STATES PATENT AND TRADEMARK OFFICE

CERTIFICATE OF CORRECTION

PATENT NO. : 6,092,318

DATED : July 25, 2000

INVENTOR(S) : Shigeyoshi Arie, et al.

It is certified that error appears in the above-identified patent and that said Letters Patent is hereby corrected as shown below:

On the title page, item [54], and at the top of Column 1, the title is incorrectly listed. It should read as follows:

--[54] SOLAR BATTERY TYPE INDICATION APPARATUS AND INDICATION APPARATUS APPLICABLE TO THE SAME--

On the title page, item [75] is incorrectly listed. The Inventors' should read as follows:

--[75] Inventors: Shigeyoshi Arie, Moriguchi-shi; Takashi Odaira, Ota-shi; Nobuaki Takai, Ora-gun; Fusao Terada, Ota-shi; Kiyondo Kobayashi, Ashikaga-shi; Yoshitaka Hara, Osato-gun; Akira Okonogi; Katuji Wakabayashi; Masashi Takazawa, all of Ora-gun, all of Japan--

On the title page, item [45] is incorrectly listed. It should be:

--[45] Date of Patent: *Jul. 25, 2000--

UNITED STATES PATENT AND TRADEMARK OFFICE

CERTIFICATE OF CORRECTION

PATENT NO. : 6,092,318

DATED : July 25, 2000

INVENTOR(S) : Shigeyoshi Arie, et al.

It is certified that error appears in the above-identified patent and that said Letters Patent is hereby corrected as shown below:

On the title page, the CPA information has been omitted. It should read as follows:

--[*] Notice: This patent issued on a continued prosecution application filed under 37 CFR 1.53(d), and is subject to the twenty year patent term provisions of 35 U.S.C. 154(a)(2)--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*